US007781702B2

(12) United States Patent
Nam et al.

(10) Patent No.: US 7,781,702 B2
(45) Date of Patent: Aug. 24, 2010

(54) COOKING APPARATUS

(75) Inventors: Young-Sok Nam, Seoul (KR); Hyeun Sik Nam, Seoul (KR); Yong Soo Lee, Gyeonggi-do (KR); Seong Ho Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/743,419

(22) Filed: May 2, 2007

(65) Prior Publication Data

US 2007/0257020 A1 Nov. 8, 2007

(30) Foreign Application Priority Data

May 4, 2006 (KR) ..... 10-2006-0040737

(51) Int. Cl.
*A21B 1/00* (2006.01)
*A47J 37/06* (2006.01)

(52) U.S. Cl. ..... 219/391; 219/392; 219/386; 219/387; 219/403; 219/396; 219/397; 219/398; 219/412; 219/780; 99/358; 99/444; 99/445; 99/446; 99/400; 99/450; 392/338; 426/233

(58) Field of Classification Search ..... 219/391–2, 219/386–7, 403, 396–8, 412, 780; 99/358, 99/444–6, 400, 450; 392/338; 426/244
See application file for complete search history.

(56) References Cited

U.S. PATENT DOCUMENTS

| | | | | |
|---|---|---|---|---|
| 6,362,458 | B1 * | 3/2002 | Sargunam et al. | 219/396 |
| 2007/0125761 | A1 | 6/2007 | Nam et al. | |
| 2007/0131670 | A1 | 6/2007 | Nam et al. | |

FOREIGN PATENT DOCUMENTS

| | | |
|---|---|---|
| KR | 1995 013320 | 5/1995 |
| KR | 20-0189093 | 5/2000 |
| KR | 10-0437414 | 6/2004 |
| KR | 20-0357899 | 7/2004 |

OTHER PUBLICATIONS

U.S. Appl. No. 11/686,465, Nam et al., filed Mar. 15, 2007.
U.S. Appl. No. 11/737,342, Nam et al., filed Apr. 19, 2007.
English language abstract of Korean Patent Publication No. 10-1995-013320.
Korean Notice of Allowance dated Nov. 28, 2007.

* cited by examiner

*Primary Examiner*—Shawntina Fuqua
(74) *Attorney, Agent, or Firm*—KED & Associates, LLP

(57) ABSTRACT

A cooking apparatus is disclosed. The cooking apparatus includes a housing having a cooking chamber and a heating unit. The heating unit includes a partition plate detachably installed in the chamber, the partition plate partitioning the chamber into sub-chambers, and a heater configured to heat at least one of the sub-chambers.

19 Claims, 4 Drawing Sheets

COOKING APPARATUS

This application claims the benefit of Korean Patent Application No. 10-2006-0040737, filed on May 4, 2006, which is hereby incorporated by reference as if fully set forth herein.

BACKGROUND OF THE INVENTION

1. Field of the Invention

The present invention relates to a cooking apparatus, and more particularly, to a cooking apparatus capable of reducing the cooking time of food.

2. Discussion of the Related Art

In general, there are a variety of types of cooking appliances, such as ovens, microwave ovens, and other suitable types of ovens. Microwave ovens are provided with only a magnetron, or both with a magnetron and a heater for cooking food. An oven is a cooking appliance designed for cooking food enclosed therein with dry heat. A heat source for supplying the heat to the food may be an electric heater or a gas heater.

In general, ovens include a cavity providing a space for receiving food to be cooked, a door for opening or closing the cavity, and a heater for cooking the food.

The cavity is a cooking chamber defined in the interior of an oven body or housing. The door is hinged on a front of the oven body defining the cooking chamber such that the door can be horizontally or vertically opened and closed.

The heater is arranged at one side of the cavity within the housing, to supply thermal energy for cooking food. The thermal energy, which is generated by the heater, is transferred to food in a convection or radiation manner.

However, conventional cooking apparatuses have the following problems.

First, there is inconvenience in that it is necessary to turn over food when the food is to be broiled at opposite surfaces thereof, because the heater used in the conventional oven can supply heat only to the upper surface of the food. For this reason, there is a problem in that the cooking time becomes long.

Second, when food to be cooked is broiled by the heater included in the conventional oven, there is a problem in that the amount of food that can be cooked in one cooking process is small because the cooking of the food can be carried out only on the upper surface of a rack installed in the oven.

Third, the conventional oven involves severe energy wasting because it is necessary to heat the entire portion of the cavity even when only a small amount of food is cooked.

SUMMARY OF THE INVENTION

Accordingly, the present invention is directed to a cooking apparatus that substantially obviates one or more problems due to limitations and disadvantages of the related art.

An object of the present invention is to provide a cooking apparatus capable of rapidly and easily cooking an object to be cooked.

Another object of the present invention is to provide a cooking apparatus capable of achieving an enhancement in energy efficiency.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a cooking apparatus includes a housing including a cooking chamber; and a heating unit including a partition plate detachably installed in the chamber, the partition plate partitioning the chamber into sub-chambers, and a heater configured to heat at least one of the sub-chambers.

The heating unit may further include a heater support detachably coupled to the partition plate, the heater support including a space in which the heater is located.

The heating unit may further include a container mounted to a lower portion of the heater support, the container being configured to hold foreign matter produced during cooking of food.

The cooking apparatus may further include a rack disposed over the heating unit, on which food is positioned for cooking. The cooking apparatus may further include support members provided in the chamber for installing the heating unit in the chamber.

The cooking apparatus may further include a power connector configured for connection to an external electric power source to supply electric power to the heating unit. The power connector may further include electric wires connected to the heater; and a plug provided at ends of the electric wires, the plug being configured for connection to a socket electrically connected to the external electric power source.

The socket may be provided with a socket cover configured to prevent foreign matter from entering the socket when the plug is not coupled to the socket.

The partition plate may include an opening corresponding to the heater. The partition plate may be at least one of glass or a transparent synthetic resin material.

The rack may include a plurality of meshes or slits such that spaces defined above and below the rack communicate via the meshes or slits. The rack may include a plate structure such that spaces defined above and below the rack are separated from each other.

The support members may include at least one pair of grooves respectively formed at opposite lateral sides of the chamber. The support members may include at least one pair of wires respectively mounted to opposite lateral sides of the chamber.

The partition plate may have a plate structure such that the sub-chambers defined above and below the partition plate are separated from each other, and the heater support is detachably coupled to a lower portion of the partition plate, such that heat from the heater is indirectly transferred to the sub-chamber above the partition plate via the partition plate, while being directly transferred to the sub-chamber below the partition plate. A container may be located on the partition plate to receive foreign matter produced from food located on a rack arranged over the heater support.

The cooking apparatus may further include a broiling heater installed in the housing, the broiling heater operating selectively or simultaneously with the heater of the heating unit. The cooking apparatus may further include an upper rack disposed over the heating unit; and a lower rack disposed beneath the heating unit, wherein food positioned respectively on the upper and lower racks is simultaneously cooked by the heater of the heating unit and the broiling heater. The cooking apparatus may further include a rack disposed over the heating unit, wherein opposite sides of food positioned on the rack are heated by the heater of the heating unit and the broiling heater, respectively.

In another aspect of the present invention, a cooking apparatus includes a housing defining a cavity configured to receive food to be cooked; a broiling heater installed in the housing; and a heating device detachably coupled to the housing. The heating device operates simultaneously with the broiling heater such that opposite sides of the food are simultaneously heated by the heating device and the broiling heater.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
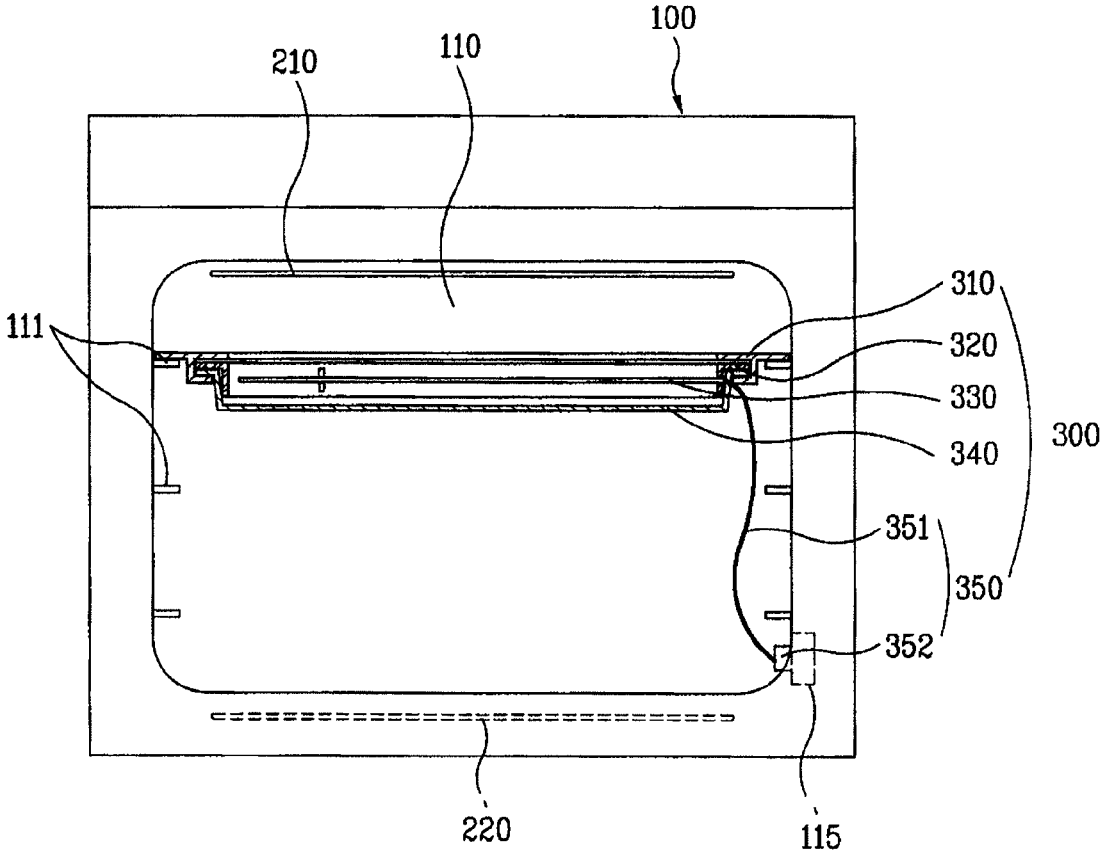
FIG. 1 is a sectional view illustrating an exemplary embodiment of a cooking apparatus according to the present invention.

Reference will now be made in detail to the preferred embodiments of the present invention, examples of which are illustrated in the accompanying drawings.

Hereinafter, a cooking apparatus according to the present invention and a heating device included in the cooking apparatus will be described in detail.

The cooking apparatus includes a body or housing 100 providing a cavity or chamber 110 as a space in which an object is cooked, a broiling heater 210 mounted to the inner top surface of the cavity or chamber 110, and a baking heater 220 mounted to an inner bottom surface of the cavity or chamber 110. The cooking apparatus also includes a heating device 300 detachably installed in the cavity 110, and a door (not shown) for opening and closing the cavity 110 of the body or housing 100.

The body 100 defines the appearance of the cooking apparatus in any suitable form, such as that of a substantially rectangular case. The cavity 110 as the space in which the object is cooked, is defined in the interior of the body 100. A control panel (not shown) for controlling the cooking apparatus is installed in any suitable location, such as on the front top surface of the body 100. The control panel may be remotely controlled.

The door is hinged to the front side of the body 100, to open and close the cavity 110. The door may be hinged so as to rotate about a horizontal axis or a vertical axis. The door may also be slidably mounted to the front side to the body 100.

Figure 2:
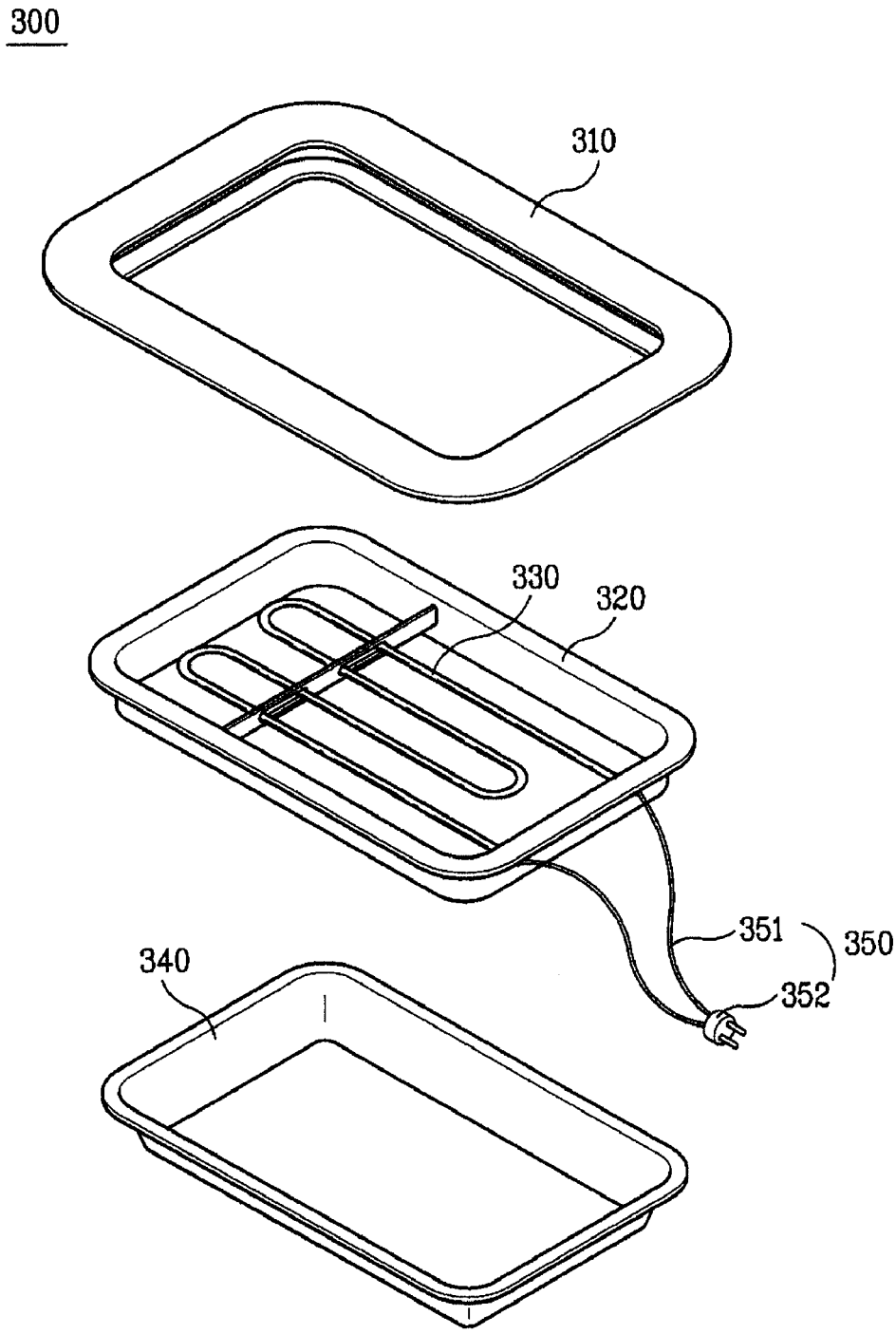
FIG. 2 is an exploded perspective view illustrating an exemplary embodiment of a heating device included in the cooking apparatus of FIG. 1.

As shown in FIG. 2, the heating device 300 includes a partition plate 310 detachably mounted in the cavity 110, and a heater 330 for heating at least a portion of a space defined by the partition plate 310 in the cavity 110.

The heating device 300 may include a heater support 320 detachably mounted to the partition plate 310, and provided with a space for receiving the heater 330. The heating device 300 may also include a storing container 340 mounted to a lower portion of the heater supporter 320, and a power connector 350 for connecting the heater 330 to an external power source.

As shown in FIG. 1, when the partition plate 310 is arranged in the cavity 110, it vertically partitions the cavity 110 into upper and lower portions. An opening is formed through a portion of the partition plate 310 corresponding to the heater 330.

Thus, heat generated from the heater 330 heats upper and lower spaces of the cavity 110 partitioned by the partition plate 310. The partition plate 310 may be made of glass or a transparent synthetic resin material.

The heater support 320 may be slidably coupled to the partition plate 310 via sliding rails formed on the partition plate 310 such that the heater support 320 is detachable in a sliding manner. Of course, the heater support 320 may be directly coupled to the partition plate 310 in any suitable manner, such as with screws. The storing container 340 may also be slidably coupled to the partition plate 310 such that the storing container 340 is detachable in a sliding manner, similarly to the heater support 320.

The power connector 350 of the heating device 300 includes electric wires 351 connected to the heater 330, and a plug 352 connected to outer ends of the electric wires 351. The plug 352 is connectable to a socket 115 mounted to one side of the cavity 110.

The socket 115 is electrically connected to an external power source, to supply electric power to the heater 330 via the plug 352 and electric wires 351. A socket cover may be provided at the socket 115. The socket cover is coupled to the socket 115 in place of the plug 352 when the plug 352 is not coupled to the socket 115, in order to prevent foreign matter such as dust from accumulating in the socket 115.

Meanwhile, support members 111 are provided in the cavity 110, in order to support the partition plate 310. In detail, the support members 111 function to support opposite lateral ends of the partition plate 310 at opposite lateral sides of the cavity 110.

The support members 111 may comprise at least one pair of grooves respectively formed at the opposite lateral sides of the cavity 110. Alternatively, the support members 111 may comprise at least one pair of steel wires respectively mounted to the opposite lateral sides of the cavity 110.

Of course, the partition plate 310 may be configured to be foldable in a condition in which it is coupled to the body 100. For example, the partition plate 310 may be hinged, at one end thereof, to the body 100 within the body 100 such that the partition plate 310 is selectively positioned to partition the cavity 110 only when the partition plate 310 is used. In this case, when the partition plate 310 is not used, it may be positioned at one side of the cavity 110.

A rack 400, on which food to be cooked will be laid, may be detachably mounted on the upper surface of the partition plate 310. A plurality of meshes or slits may be provided at the rack 400 such that spaces respectively defined at upper and lower sides of the rack 400 communicate via the meshes or slits.

The meshes or slits allow foreign matter produced from the food laid on the rack 400 to be dropped into and received in the storing container 340 of the heating device 300 arranged beneath the rack 400.

Of course, the rack 400 may have a plate structure having no mesh or slit. In this case, the rack 400 may be a cooking container for receiving food, such as bread or cookie, to be baked.

Although not shown, the partition plate 310 may have a plate structure having no opening such that spaces respectively defined at upper and lower sides of the partition plate 310 are separated from each other in the form of independent spaces. That is, the partition plate 310 itself may function as a cooking container for baking food.

The present invention is not limited to the above-described configurations. For example, a tray, on which food to be cooked will be laid, may be installed within the cavity 110. The tray may be fixed in the cavity 110, or may be rotatable in the cavity 110. When the tray rotates during a procedure of cooking food, it is possible to more uniformly cook the food. In order to rotate the tray, a drive motor (not shown) may be arranged beneath the tray. A power transmission (not shown) may also be installed to transmit the rotating force of the drive motor to the tray.

Although not shown, a convection heater may be arranged at the rear side of the cavity 110, in addition to the broiling heater 210 and baking heater 220. The convection heater functions to auxiliarily supply heat energy to the food received in the cavity 110. In this case, inlet holes are formed through the rear side of the cavity 110, to enable hot air to be introduced into the cavity 110. The convection heater is arranged outside the cavity 110. A convection fan may also be arranged outside the cavity 110, in order to form an air flow functioning to supply hot air generated by the convection heater into the cavity 110.

The heating device 300 may cook food, independently of the cooking apparatus, because it is electrically connected to the external power source via the power connector 350. In detail, the heating device 300 can be used anywhere, as long as it can be connected to an external electric power source.

Figure 3:
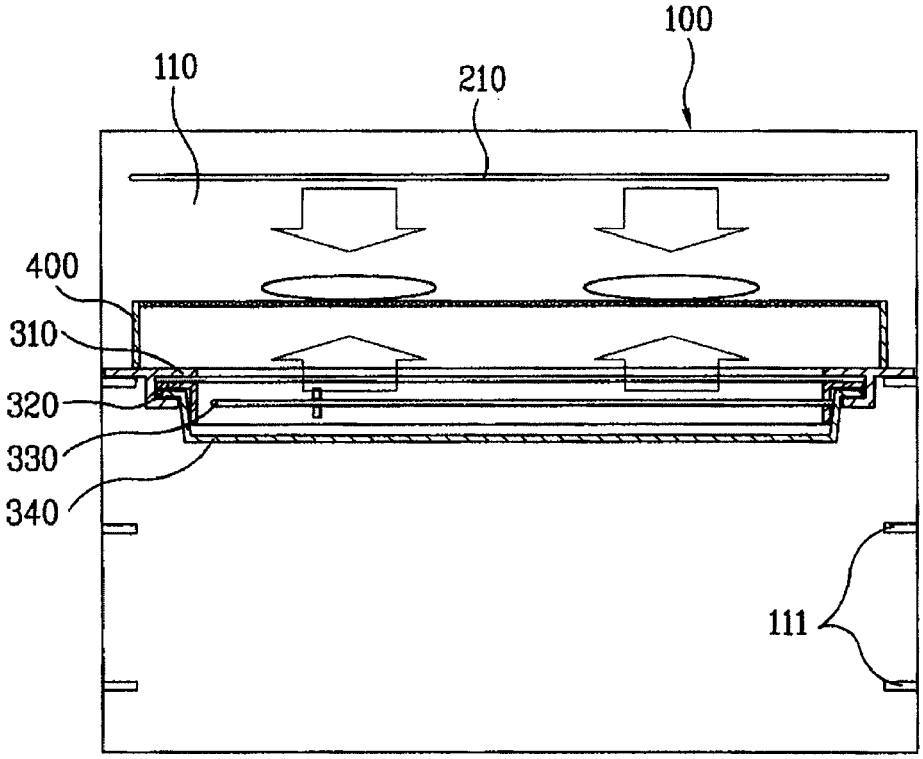
FIG. 3 is a sectional view illustrating a food cooking mode carried out in the cooking apparatus according to the present invention.
Figure 4:
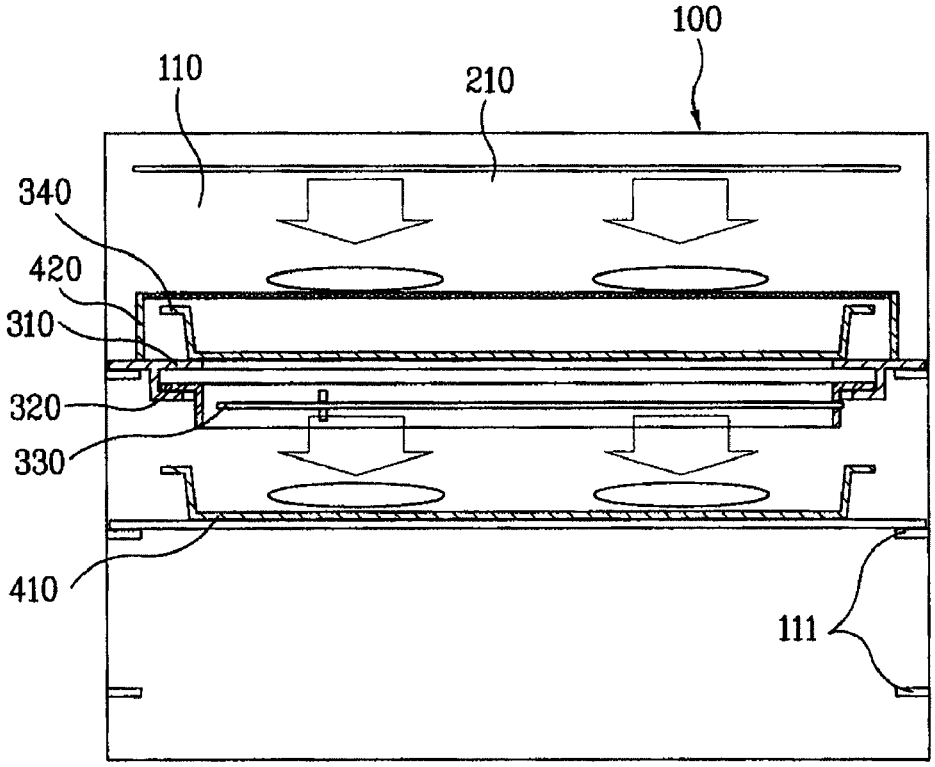
FIG. 4 is a sectional view illustrating another food cooking mode carried out in the cooking apparatus according to the present invention.

Hereinafter, the procedure of cooking food using the cooking apparatus according to the present invention will be described with reference to FIGS. 3 and 4.

First, the user lays the partition plate 310 of the heating device 300 on the support members 111 mounted in the cavity 110. The user then lays the rack 400, on which food to be cooked is laid, on the heating device 300. Subsequently, the user selects a desired cooking mode using the control panel, and then presses a cooking start button.

As a result, electric power from an external electric power source is selectively supplied to the broiling heater 210, the baking heater 220, or the heater 330 of the heating device 300. For example, at least one of the broiling heater 210 and baking heater 220 and the heater 330 of the heating device 300 may operate simultaneously. Alternatively, the heater 330 of the heating device 300, broiling heater 210, and baking heater 220 can operate independently.

For example, when the user desires to cook food in a broiling mode, the broiling heater 210 and the heater 330 of the heating device 300 operate simultaneously. In this case, heat is directly applied to the upper and lower surfaces of the food in one cooking procedure. Accordingly, the broiling procedure for the food can be rapidly carried out. During this cooking procedure, foreign matter produced from the food, such as oil, is received in the storing container 340.

Meanwhile, although not shown, the broiling heater 210 and the heater 330 of the heating device 300 operate simultaneously when the user operates the cooking apparatus after laying a food to be cooked on the plate-shaped rack 400 in a baking mode.

In this case, the broiling heater 210 directly applies heat to the food, whereas the heater 330 of the heating device 300 indirectly applies heat to the food via the rack. Thus, the food baking procedure can be more rapidly carried out.

Hereinafter, a procedure for cooking pieces of food respectively disposed in a plurality of spaces using the heating device according to the present invention will be described with reference to FIG. 4.

In this embodiment, a plurality of racks, for example, an upper rack 420 and a lower rack 410, are provided. In this case, pieces of food, to be cooked, laid on the racks are simultaneously cooked by respective heaters.

In detail, the upper rack 420 is disposed over the heating device 300, and the lower rack 410 is disposed beneath the heating device 300. The storing container 340 is arranged beneath the upper rack 420. The storing container 340 is supported by the partition plate 310 which is arranged beneath the storing container 340.

The heater supporter 320 is arranged beneath the partition plate 310, in order to receive the heater 330 of the heating device 300. The lower rack 410 is arranged beneath the heater supporter 320.

When the user operates the cooking apparatus after laying pieces of food on the lower rack 410 and upper rack 420, the broiling heater 210 and the heater 330 of the heating device 300 operate simultaneously.

As a result, the pieces of food laid on the upper rack 420 and lower rack 410 are simultaneously cooked in one cooking procedure.

That is, the broiling heater 210 cooks the food laid on the upper rack 420 arranged over the heating device 300. The heater 330 of the heating device 300 cooks the food laid on the lower rack 410 arranged beneath the heating device 300. Thus, the pieces of food on the upper rack 420 and lower rack 410 are simultaneously cooked.

The above-described cooking apparatus has the following effects.

First, in accordance with the cooking apparatus of the present invention, there is an advantage of a reduction in cooking time because it is possible to simultaneously heat the opposite sides of food.

Second, in accordance with the cooking apparatus of the present invention, there is an advantage in that it is possible to simultaneously cook various pieces of food in one cooking procedure.

Third, in accordance with the cooking apparatus of the present invention, there is an advantage of a satisfaction of the user's preferences, because it is possible to achieve various cooking modes in accordance with the user's taste associated with the cooked state of food and the kind of food.

It will be apparent to those skilled in the art that various modifications and variations can be made in the present invention. Thus, it is intended that the present invention covers such modifications and variations of the invention.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Although the invention has been described with reference to exemplary embodiments, it is understood that the words that have been used are words of description and illustration, rather than words of limitation. As the present invention may be embodied in several forms without departing from the spirit or essential characteristics thereof, it should also be understood that the above-described embodiment is not limited by any of the details of the foregoing description, unless otherwise specified. Rather, the above-described embodiment should be construed broadly within the spirit and scope of the present invention as defined in the appended claims. Therefore, changes may be made within the metes and bounds of the appended claims, as presently stated and as amended, without departing from the scope and spirit of the invention in its aspects.

What is claimed is:

1. A cooking apparatus comprising:

a housing including a cooking chamber;

support members provided in the cooking chamber; and a heating unit comprising:

a partition plate detachably installed within the chamber, the partition plate partitioning the chamber into a first sub-chamber defined at an upper side of the partition plate and a second sub-chamber defined at a lower side of the partition plate, the partition plate having sliding rails formed thereof, a heater support slidably coupled to the partition plate via the sliding rails, a heater supported by the heater support and configured to heat at least one of the first sub-chamber and the second sub-chamber, a rack disposed over the heating unit, on which food is positionable for cooking, a power connector configured to selectively connect to an external electric power source to supply electric power to the heating unit, and a container slidably coupled to the partition plate via the sliding rails to hold foreign matter produced during cooking of food, wherein the heater support comprises sidewalls that define openings provided in the upper surface and the lower surface of the heater support such that the heater support is configured to allow the heat from the heater to be transferred to upper and lower sides of the heater support, and wherein the partition plate is supported by the support members.

2. The cooking apparatus according to claim 1, wherein the heater support comprises a space in which the heater is located.

3. The cooking apparatus according to claim 2, wherein the container is mounted to a lower portion of the heater support.

4. The cooking apparatus according to claim 1, wherein the power connector comprises:

electric wires connected to the heater; and a plug provided at ends of the electric wires, the plug being configured to connect to a socket that is to electrically connect to the external electric power source.

5. The cooking apparatus according to claim 4, wherein the socket is provided with a socket cover configured to prevent foreign matter from entering the socket when the plug is not coupled to the socket.

6. The cooking apparatus according to claim 1, wherein the partition plate includes an opening corresponding to the heater.

7. The cooking apparatus according to claim 1, wherein the partition plate is at least one of glass or a transparent synthetic resin material.

8. The cooking apparatus according to claim 1, wherein the rack includes a plurality of meshes or slits such that spaces defined above and below the rack communicate via the meshes or slits.

9. The cooking apparatus according to claim 1, wherein the rack has a plate structure such that spaces defined above and below the rack are separated from each other.

10. The cooking apparatus according to claim 1, wherein the support members comprise at least one pair of grooves respectively formed at opposite lateral sides of the chamber.

11. The cooking apparatus according to claim 1, wherein the support members comprise at least one pair of wires respectively mounted to opposite lateral sides of the chamber.

12. The cooking apparatus according to claim 1, wherein the partition plate has a plate structure that separates the first and second sub-chambers from each other, and the heater support is detachably coupled to a lower portion of the partition plate, such that heat from the heater is indirectly transferred to the first sub-chamber via the partition plate, while being directly transferred to the second sub-chamber.

13. The cooking apparatus according to claim 12, wherein the container located on the partition plate to receive foreign matter produced from food located on the rack positioned over the heater support.

14. The cooking apparatus according to claim 1, further comprising:

a broiling heater installed in the housing, the broiling heater operating selectively or simultaneously with the heater of the heating unit.

15. The cooking apparatus according to claim 14, further comprising:

an upper rack positioned over the heating unit; and a lower rack positioned beneath the heating unit, wherein food positioned respectively on the upper and lower racks is simultaneously cooked by the heater of the heating unit and the broiling heater.

16. The cooking apparatus according to claim 14, wherein opposite sides of food positioned on the rack are heated by the heater of the heating unit and the broiling heater, respectively.

17. A cooking apparatus comprising:

a housing defining a cavity configured to receive food to be cooked;

a broiling heater installed within the housing;

a heating device detachably coupled to the housing, the heating device operating simultaneously with the broiling heater such that opposite sides of the food are simultaneously heated by the heating device and the broiling heater;

wherein the heating device comprises:

a partition plate detachably installed within the cavity, the partition plate partitioning the cavity into a first sub-cavity defined at an upper side of the partition plate and a second sub-cavity defined at a lower side of the partition plate, a heater configured to heat at least one of the sub-cavities, a heater support slidably coupled to the partition plate and configured to support the heater, and a container slidably coupled to the partition plate to hold foreign matter produced during cooking of food, wherein the heater support comprises sidewalls that define openings provided in the upper and lower surfaces of the heater support such that the heater support is configured to allow the heat from the heater to be transferred to upper and lower sides of the heater support.

18. The cooking apparatus according to claim 17, wherein the partition plate has sliding rails, and the container is slidably coupled to the partition plate via the sliding rails.

19. The cooking apparatus according to claim 18, wherein the heater support is slidably coupled to the partition plate via the sliding rails.

* * * * *